US009296401B1

(12) United States Patent
Palmer et al.

(10) Patent No.: US 9,296,401 B1
(45) Date of Patent: Mar. 29, 2016

(54) RAIL VEHICLE EVENT TRIGGERING SYSTEM AND METHOD

(71) Applicant: SmartDrive Systems, Inc., San Diego, CA (US)

(72) Inventors: Jason Palmer, Carlsbad, CA (US); Slaven Sljivar, San Diego, CA (US); Mark Freitas, San Diego, CA (US); Daniel A. Deninger, San Diego, CA (US); Shahriar Ravari, San Diego, CA (US)

(73) Assignee: SMARTDRIVE SYSTEMS, INC., San Diego, CA (US)

( * ) Notice: Subject to any disclaimer, the term of this patent is extended or adjusted under 35 U.S.C. 154(b) by 0 days.

(21) Appl. No.: 14/594,387

(22) Filed: Jan. 12, 2015

(51) Int. Cl.
*G05D 1/00* (2006.01)
*B61L 15/00* (2006.01)
*B61L 3/00* (2006.01)

(52) U.S. Cl.
CPC ..... *B61L 15/0072* (2013.01); *B61L 3/002* (2013.01)

(58) Field of Classification Search
USPC ..... 701/19
See application file for complete search history.

(56) References Cited

U.S. PATENT DOCUMENTS

2012/0269383 A1* 10/2012 Bobbitt ..... B61L 17/00 382/103
2013/0018534 A1* 1/2013 Hilleary ..... B61L 27/00 701/19
2013/0048795 A1* 2/2013 Cross ..... B61L 15/0027 246/122 R
2014/0339374 A1* 11/2014 Mian ..... G08G 1/0175 246/473.1
2015/0000415 A1* 1/2015 Kelley ..... B61L 5/206 73/649

* cited by examiner

*Primary Examiner* — Hussein A. Elchanti
(74) *Attorney, Agent, or Firm* — Sheppard Mullin Richter & Hampton LLP

(57) ABSTRACT

This disclosure relates to a system configured to detect rail vehicle events. Some or all of the system may be installed in a rail vehicle and/or be otherwise coupled with the rail vehicle. In some implementations, the system may detect rail vehicle events based on pre-determined rail vehicle event criteria sets. The system may include one or more sensors configured to generate output signals conveying information related to the rail vehicle. In some implementations, the system may detect rail vehicle events based on a comparison of the information conveyed by the output signals from the sensors and/or parameters determined based on the output signals to the pre-determined rail vehicle event criteria sets.

28 Claims, 3 Drawing Sheets

RAIL VEHICLE EVENT TRIGGERING SYSTEM AND METHOD

FIELD

This disclosure relates to a system and method for detecting rail vehicle events.

BACKGROUND

Typically, trains are not equipped with vehicle event detection systems. Some trains are equipped with cameras but these cameras are usually only used for surveillance purposes to monitor interior passenger compartments. The cameras are not connected to mechanical and/or safety subsystems of the train in any way and are not used to detect rail vehicle events.

SUMMARY

One aspect of the disclosure relates to a system configured to detect rail vehicle events based on pre-determined rail vehicle event criteria sets. The system may be coupled to a rail vehicle. The system may comprise one or more sensors, one or more physical computer processors, and/or other components.

The one or more sensors may be configured to generate output signals conveying information related to operation and/or context of the rail vehicle. In some implementations, generating output signals conveying information related to the operation and/or the context of the rail vehicle may include acquiring visual information representing the rail vehicle environment. The rail vehicle environment may include spaces in and around an interior and an exterior of the rail vehicle. In some implementations, the output signals may convey information related to safety systems of the rail vehicle, mechanical systems of the rail vehicle, communication systems of the rail vehicle, passengers riding in the rail vehicle, an operator of the rail vehicle, movement of the rail vehicle, an orientation of the rail vehicle, a geographic position of the rail vehicle, a track the rail vehicle rides on, a spatial position of the rail vehicle relative to other objects, and/or other information. Such output signals may be generated by one or more rail vehicle subsystem sensors, one or more third party aftermarket sensors, and/or other sensors. In some implementations, the one or more sensors may be configured to generate output signals that convey information related to biological activity (e.g., heart rate, respiration rate, verbal expressions, responses to conditions in the physical environment in and/or around the rail vehicle, etc.) of a vehicle operator.

The one or more physical computer processors may be configured by computer readable instructions to: determine one or more rail vehicle parameters and/or rail vehicle operator parameters based on the output signals, the one or more rail vehicle and/or rail vehicle operator parameters being related to the operation and/or context of the rail vehicle, the biological activity of the rail vehicle operator, and/or other information; obtain one or more pre-determined rail vehicle event criteria sets, the one or more pre-determined rail vehicle event criteria sets including criteria sets associated with individual rail vehicle events, the one or more pre-determined rail vehicle event criteria sets including a first criteria set that corresponds to a first rail vehicle event, the first criteria set including a first individual criterion; and detect individual rail vehicle events based on the determined parameters and the obtained pre-determined rail vehicle event criteria sets by comparing the determined parameters to the criteria sets such that the first rail vehicle event is detected responsive to the determined parameters satisfying the first criteria set.

Examples of detected vehicle events may include collisions with other vehicles and/or pedestrians, near collisions, a specific behavior and/or driving maneuver performed by a rail vehicle operator (e.g., unsafe backing, unsafe braking, unsafe railroad crossing, unsafe turning, operating the rail vehicle with hands off of the control lever and/or any other similar maneuver such as operating the rail vehicle without a foot on a foot controller (for example), passing a signal bar, passing red over red, failure to yield to pedestrians, failure to yield to vehicles, speeding, not checking mirrors, not scanning the road/tracks ahead, not scanning an intersection, operating a personal electronic device, intercom responds, being distracted while eating, drinking, reading, etc., slingshotting, following or not following a transit agency's standard operating procedure), penalty stops, activation of a specific rail vehicle safety system (such as a track brake and/or an emergency brake), train operating parameters (e.g., speed) exceeding threshold values, improper stops at stations, activation of an automatic train protection (ATP) overspeed system, activation of an ATP bypass switch, sounding a high horn of the rail vehicle, activation of a communications based train control (CBTC) system, and/or other rail vehicle events.

In some implementations, multiple individual parameters may need to satisfy multiple individual criteria in a criteria set before a rail vehicle event is detected. In some implementations, a single parameter may satisfy rail vehicle event criteria for a specific rail vehicle event all by itself.

In some implementations, the system may be configured to filter detected rail vehicle events based on pre-determined geo-fences, and/or other information. The geo-fences may be virtual boundaries that define physical areas where one or more rail vehicle events are permissible or are not permissible. In some implementations, this may include adjusting individual criteria in the rail vehicle event criteria sets based on a physical location of the rail vehicle relative to the pre-determined geo-fences.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
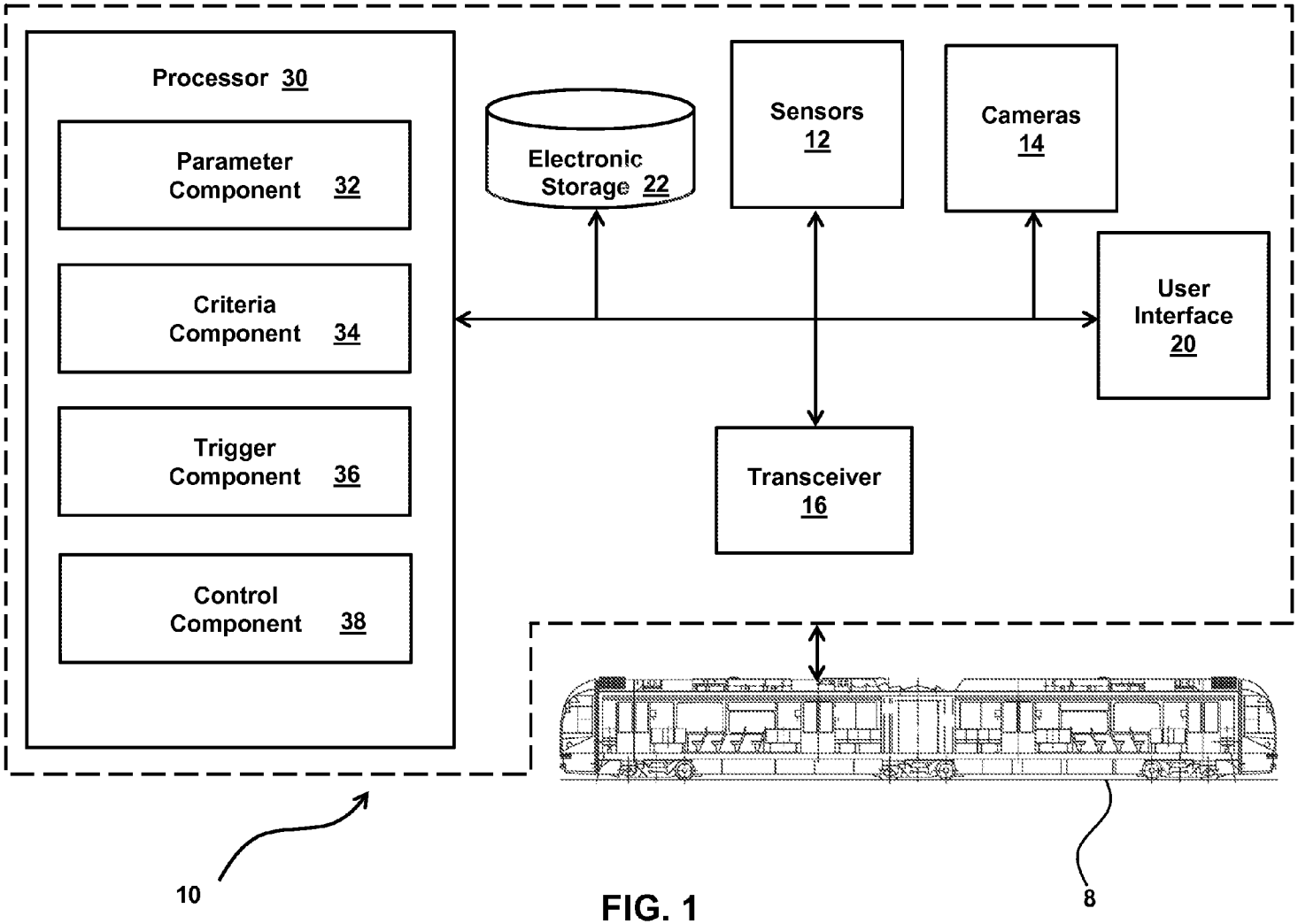
FIG. 1 illustrates a system configured to detect rail vehicle events.

FIG. 1 illustrates a system 10 configured to detect rail vehicle events. Some or all of system 10 may be installed in a rail vehicle 8 and/or be otherwise coupled with and/or in communication with rail vehicle 8. In some implementations, system 10 may detect rail vehicle events based on pre-determined rail vehicle event criteria sets. System 10 may include one or more sensors 12 configured to generate output signals conveying information related to rail vehicle 8. In some implementations, system 10 may detect rail vehicle events based on a comparison of the information conveyed by the output signals from sensors 12 to the pre-determined rail vehicle event criteria sets. In some implementations, system 10 may detect rail vehicle events based on a comparison of parameters determined from the information in the output signals to the criteria sets. Advantageously, system 10 may identify rail vehicle events in real-time or near real-time during operation of rail vehicle 8 based on the comparisons. In some implementations, system 10 may include one or more of sensor 12, a camera 14, a transceiver 16, a user interface 20, electronic storage 22, a processor 30, and/or other components.

System 10 may be configured to monitor operation of rail vehicle 8, the rail vehicle operator, rail vehicle passengers, the environment about rail vehicle 8, and/or other factors related to rail vehicle 8, and detect rail vehicle events. By way of a non-limiting example, rail vehicle events may include collisions with other vehicles and/or pedestrians, near collisions, a specific behavior and/or driving maneuver performed by a rail vehicle operator (e.g., unsafe backing, unsafe braking, unsafe railroad crossing, unsafe turning, operating rail vehicle 8 with hands off of the control lever and/or any other similar maneuver such as operating rail vehicle 8 without a foot on a foot controller (for example), passing a signal bar, passing red over red, failure to yield to pedestrians, failure to yield to vehicles, speeding, not checking mirrors, not scanning the road/tracks ahead, not scanning an intersection, operating a personal electronic device, intercom responds, being distracted while eating, drinking, reading, etc., slingshotting, following or not following a transit agency's standard operating procedure), penalty stops, activation of a specific rail vehicle safety system (such as a track brake and/or an emergency brake), train operating parameters (e.g., speed) exceeding threshold values, improper stops at stations, activation of an automatic train protection (ATP) overspeed system, activation of an ATP bypass switch, sounding a high horn of rail vehicle 8, activation of a communications based train control (CBTC) system, and/or other rail vehicle events. Responsive to determining that a rail vehicle event has occurred, system 10 may be configured to record rail vehicle event information and/or transmit the recorded rail vehicle event information to one or more remotely located computing devices (e.g., wirelessly and/or via wires). The rail vehicle event information may include visual images of the environment about rail vehicle 8 (e.g., the exterior of rail vehicle 8, streets surrounding rail tracks, passenger compartments, operator compartments, etc.), sensor information generated by rail vehicle system sensors and/or aftermarket sensors installed as part of system 10 (e.g., sensors 12), operator information, and/or other information.

In some implementations, one or more of the components of system 10 may form at least a portion of a rail vehicle event detection system such as the rail vehicle event detection system described in U.S. patent application Ser. No. 14/525,416 filed Oct. 28, 2014 and entitled, "Rail Vehicle Event Detection and Recording System", which is incorporated herein by reference in its entirety.

Sensors 12 may be configured to generate output signals conveying information related to the operation and/or context of rail vehicle 8, and/or other information. In some implementations, the output signals may convey information related to safety systems of rail vehicle 8, mechanical systems of rail vehicle 8, communication systems of rail vehicle 8, passengers riding in rail vehicle 8, an operator of rail vehicle 8, movement of rail vehicle 8, an orientation of rail vehicle 8, a geographic position of rail vehicle 8, a track rail vehicle 8 rides on, a spatial position of rail vehicle 8 relative to other objects, and/or other information. Such output signals may be generated by one or more vehicle subsystem sensors (e.g., included in a vehicle on-board data system), one or more third party aftermarket sensors, and/or other sensors 12.

Information related to the operation of vehicle 12 may include feedback information from one or more subsystems of rail vehicle 8, and/or other information. The subsystems may include, for example, the engine, the drive train, lighting systems (e.g., headlights, brake lights, train status indicator lights, track information lighting/signage), the braking system, power delivery (e.g., mechanical and/or electrical) systems, safety systems, radio systems, dispatch systems, and/or other subsystems. The subsystems of rail vehicle 8 may include one or more mechanical sensors, electronic sensors, and/or other sensors that generate output signals. In some implementations, sensors 12 may include at least one sensor that is a rail vehicle subsystem sensor associated with mechanical systems of rail vehicle 8 (e.g., the engine, drive train, lighting, braking, power delivery systems, etc.). In some implementations, sensor 12 may include at least one sensor 12 that is a rail vehicle subsystem sensor associated with a rail vehicle safety system configured to generate output signals conveying information related to safety systems of rail vehicle 8. Rail vehicle safety subsystem sensors 12 may include automatic train protection (ATP) sensors (e.g., ATP bypass active, ATP overspeed sensors), an automatic train control system (ATCS), track switches, track brake sensors, emergency brake sensors, intercom call sensors, a high horn sensor, a slingshotting sensor (e.g., a sensor that conveys output signals that indicate whether a side to side g-force at a last rail car when the rail car speed is too high causes passenger discomfort, has the potential to cause derailment, an/or may cause damage to the rail car and/or the track), and/or other sensors.

Information related to the context of rail vehicle 8 may include information related to the environment in and/or around rail vehicle 8. The vehicle environment may include spaces in and around an interior and an exterior of rail vehicle 8. The information related to the context of rail vehicle 8 may include information related to movement of rail vehicle 8, an orientation of rail vehicle 8, a geographic position of rail vehicle 8, a spatial position of rail vehicle 8 relative to other objects, a tilt angle of rail vehicle 8, and/or other information. In some implementations, the output signals conveying the information related to the context of rail vehicle 8 may be generated via non-standard aftermarket sensors 12 installed in rail vehicle 8 and/or other sensors 12. The non-standard aftermarket sensor 12 may include, for example, a video camera (e.g., cameras 14 described below), a microphone, an accelerometer, a gyroscope, a geolocation sensor (e.g., a GPS device), a radar detector, a magnetometer, radar, biometric sensors, an intercom, an active safety sensor that utilizes a camera to detect objects on tracks with which the rail vehicle may collide and/or for other purposes (e.g., such as Mobile Eye® and/or Bendix®), and/or other sensors. In some implementations, the output signals may include information from a communications based train control (CBTC) system and/or other external signals received from third party rail safety products.

In some implementations, sensor 12 may include one or more sensors configured to generate output signals that convey information related to biological activity of the rail vehicle operator. In some implementations, such sensors may be wearable by the rail vehicle operator. In some implementations, such sensors may be placed in physical proximity to the rail vehicle operator to facilitate monitoring the biological activity of the rail vehicle operator. The information related to the biological activity of the rail vehicle operator may include heart rate, respiration rate, verbal expressions, responses to conditions in the physical environment in and/or around rail vehicle 8, and/or other characteristics of the rail vehicle operator. For example, one or more sensors 12 may generate an output based on a heart rate of subject 12 (e.g., sensor 12 may be a heart rate sensor located on the chest of the rail vehicle operator, and/or be configured as an optical sensor included in a bracelet on a wrist of the rail vehicle operator, and/or be located on another limb of the rail vehicle operator), movement of the rail vehicle operator (e.g., sensor 12 may include a bracelet around the wrist and/or ankle of the rail vehicle operator with an accelerometer such that physical reactions may be analyzed using actigraphy signals), changes in skin color of the rail vehicle operator (e.g., sensor 12 may include a camera that can detect changes is skin color of the rail vehicle operator and infer vital signs such as heart rate, breathing rate, and/or other vital signs from the changes in color), respiration of the rail vehicle operator, brain waves of the vehicle operator (e.g., sensor 12 may generate output signals related to an electroencephalogram (EEG) of the rail vehicle operator), and/or other characteristics of the rail vehicle operator.

Although sensor 12 is depicted in FIG. 1 as a single element, this is not intended to be limiting. Sensor 12 may include one or more sensors located adjacent to and/or in communication with the various mechanical systems of rail vehicle 8, adjacent to and/or in communication with the various safety systems of rail vehicle 8, in one or more positions (e.g., at or near the front/rear of rail vehicle 8) to accurately acquire information representing the vehicle environment (e.g. visual information, spatial information, orientation information), in one or more locations to monitor biological activity of the rail vehicle operator (e.g., worn by the rail vehicle operator), and/or in other locations. For example, in some implementations, system 10 may be configured such that a first sensor is located in a driver compartment of rail vehicle 8 near operational control used to operate rail vehicle 8 and a second sensor is located on top of rail vehicle 8 and is in communication with a geolocation satellite. In some implementations, sensor 12 may be configured to generate output signals substantially continuously during operation of rail vehicle 8.

Camera 14 may be configured to acquire visual information representing a rail vehicle environment. Any number of individual cameras 14 may be positioned at various locations on and/or within rail vehicle 8. The rail vehicle environment may include spaces in and around an interior and/or an exterior of rail vehicle 8. Cameras 14 may be configured such that the visual information includes views of exterior sides of rail vehicle 8, interior compartments of rail vehicle 8, and/or other areas to capture visual images of activities that occur at or near the sides of rail vehicle 8, in front of and/or behind rail vehicle 8, within rail vehicle 8, on streets surrounding rail vehicle tracks, and/or in other areas. In some implementations, cameras 14 may include multiple cameras positioned around rail vehicle 8 and synchronized together to provide a 360 degree and/or other views of the inside of one or more portions of rail vehicle 8 (e.g., a driver compartment, a passenger compartment) and/or a 360 degree and/or other views of the outside of the vehicle (e.g., at or near a leading end of rail vehicle 8 looking ahead toward upcoming traffic, street crossings, etc.). In some implementations, one or more cameras 14 may be rail vehicle system cameras previously installed in rail vehicle 8. In some implementations, one or more cameras 14 may be a third party aftermarket camera coupled with rail vehicle 8. In some implementations, the visual information may be received from a third party camera and/or digital video recorder (DVR) system. For example, such systems may include systems similar to and/or the same as the system described in U.S. patent application Ser. No. 14/540,825 filed Nov. 13, 2014 and entitled, "System And Method For Detecting A Vehicle Event And Generating Review Criteria" (which is incorporated herein by reference in its entirety), and/or other systems. As described above, in some implementations, sensors 12 may include one or more cameras 14. For example, the output signals from sensors 12 may include output signals that convey the visual information acquired by cameras 14.

Processor 30 may be configured to provide information processing capabilities in system 10. As such, processor 30 may comprise one or more of a digital processor, an analog processor, a digital circuit designed to process information, an analog circuit designed to process information, a state machine, and/or other mechanisms for electronically processing information. Although processor 30 is shown in FIG. 1 as a single entity, this is for illustrative purposes only. In some implementations, processor 30 may comprise a plurality of processing units. These processing units may be physically located within the same device, or processor 30 may represent processing functionality of a plurality of devices operating in coordination.

Processor 30 may be configured to execute one or more computer program components. The computer program components may comprise one or more of a parameter component 32, a criteria component 34, a trigger component 36, a control component 38, and/or other components. Processor 30 may be configured to execute components 32, 34, 36, and/or 38 by software; hardware; firmware; some combination of software, hardware, and/or firmware; and/or other mechanisms for configuring processing capabilities on processor 30. It should be appreciated that although components 32, 34, 36, and 38 are illustrated in FIG. 1 as being co-located within a single processing unit, in implementations in which processor 30 comprises multiple processing units, one or more of components 32, 34, 36, and/or 38 may be located remotely from the other components. The description of the functionality provided by the different components 32, 34, 36, and/or 38 described herein is for illustrative purposes, and is not intended to be limiting, as any of components 32, 34, 36, and/or 38 may provide more or less functionality than is described. For example, one or more of components 32, 34, 36, and/or 38 may be eliminated, and some or all of its functionality may be provided by other components 32, 34, 36, and/or 38. As another example, processor 30 may be configured to execute one or more additional components that may perform some or all of the functionality attributed below to one of components 32, 34, 36, and/or 38.

Parameter component 32 may be configured to determine one or more rail vehicle parameters, one or more rail vehicle operator parameters, and/or other parameters. In some implementations, the rail vehicle parameters, the rail vehicle operator parameters, and/or other parameters may be and/or include sensor outputs (e.g., sensor signals indicating a level of a parameter are simply passed through), the parameters may include parameters determined based on sensor outputs, and/or other parameters. For example, the rail vehicle parameters, the rail vehicle operator parameters, and/or other parameters may include a sensor reading (output signal) indicating that the rail vehicle high horn has sounded/been activated. In some embodiments, the parameters may be determined based on the output signals from sensors 12, information received via user interface 20, information received from external systems and/or databases, and/or other information. In some implementations, parameter component 32 may determine the one or more vehicle parameters, the one or more rail vehicle operator parameters, and/or other parameters based on an analysis of the output signals from one or more sensors 12 (e.g., to determine parameters that are not directly measurable by any of the available sensors). In some implementations, parameter component 32 may determine the one or more vehicle parameters, the one or more rail vehicle operator parameters, and/or other parameters based on the output signals from two or more different sensors 12. In some implementations, parameter component 32 may be configured to determine one or more of the parameters one or more times in an ongoing manner during operation of rail vehicle 8. In some implementations, parameter component 32 may be configured to determine one or more of the parameters at regular time intervals during operation of rail vehicle 8. The timing of the parameter determinations (e.g., in an ongoing manner, at regular time intervals, etc.) may be programmed at manufacture, obtained responsive to user entry and/or selection of timing information via user interface 20 and/or a remote computing device, and/or may be determined in other ways.

The one or more rail vehicle parameters may be related to the operation and/or context of rail vehicle 8 and/or other information. In some implementations, the one or more rail vehicle parameters may be related to safety systems of rail vehicle 8, mechanical systems of rail vehicle 8, communication systems of rail vehicle 8, passengers riding in rail vehicle 8, an operator of rail vehicle 8, movement of rail vehicle 8, an orientation of rail vehicle 8, a geographic position of rail vehicle 8, a track rail vehicle 8 rides on, a spatial position of rail vehicle 8 relative to other objects, and/or other information. For example, the one or more rail vehicle parameters may include a binary indicator of whether a specific safety system and/or communication system of rail vehicle 8 has been activated, a number of passengers riding rail vehicle 8, a speed of rail vehicle 8, an acceleration/deceleration of rail vehicle 8, a tilt angle of rail vehicle 8, an inclination/declination angle of rail vehicle 8, geographic coordinates representative of the rail vehicle's physical location, a direction of travel, a track identifier of the individual track and/or section of track rail vehicle 8 is riding on, distances between rail vehicle 8 and other objects, a closing distance between rail vehicle 8 and another object, physical characteristics of rail vehicle 8 (e.g., a mass, a number of rail cars, etc.), and/or other rail vehicle parameters.

In some implementations, the one or more rail vehicle operator parameters may be related to an excitement level of the rail vehicle operator, and/or other characteristics of the rail vehicle operator. Such parameters may include, for example, heart rate, respiration rate, an indicator that indicates a specific verbal expression was used by the rail vehicle operator, an amount of movement of the rail vehicle operator, an indicator that indicates changes in skin color of the rail vehicle operator, a voltage that indicates brain activity of the vehicle operator, and/or other characteristics of the rail vehicle operator.

Criteria component 34 may be configured to obtain one or more pre-determined rail vehicle event criteria sets. The one or more pre-determined rail vehicle event criteria sets may include criteria sets associated with individual rail vehicle events and/or other criteria sets. The pre-determined criteria sets may be programmed at manufacture, obtained by criteria component 34 responsive to user entry and/or selection of information related to pre-determined rail vehicle event criteria sets via user interface 20 and/or remote computing devices, obtained from electronic storage 22, and/or may be obtained in other ways. The criteria sets may include one or more individual criteria characterizing a specific rail vehicle event. For example, the one or more pre-determined rail vehicle event criteria sets may include a first criteria set that corresponds to a first rail vehicle event. The first criteria set may include one or more individual criteria that characterize the first vehicle event, for example.

In some implementations, criteria component 34 may be configured to obtain criteria sets for specific rail vehicle events such as collisions with other vehicles and/or pedestrians, near collisions, a specific behavior and/or driving maneuver performed by a rail vehicle operator (e.g., unsafe backing, unsafe braking, unsafe railroad crossing, unsafe turning, operating rail vehicle 8 with hands off of the control lever and/or any other similar maneuver such as operating rail vehicle 8 without a foot on a foot controller (for example), passing a signal bar, passing red over red, failure to yield to pedestrians, failure to yield to vehicles, speeding, not checking mirrors, not scanning the road/tracks ahead, not scanning an intersection, operating a personal electronic device, intercom responds, being distracted while eating, drinking, reading, etc., slingshotting, following or not following a transit agency's standard operating procedure), penalty stops, activation of a specific rail vehicle safety system (such as a track brake and/or an emergency brake), train operating parameters (e.g., speed) exceeding threshold values, improper stops at stations, activation of an automatic train protection (ATP) overspeed system, activation of an ATP bypass switch, sounding a high horn of rail vehicle 8, activation of a communications based train control (CBTC) system, and/or other rail vehicle events.

In some implementations, criteria component 34 may be configured such that the pre-determined rail vehicle event criteria sets describe one or more geo-fences. An individual geo-fence may be a virtual boundary line that defines, represents, and/or is otherwise related to a physical area (e.g., an intersection where rail tracks cross over a major street), a point of interest, a track segment, a rail yard, and/or other physical locations. Geo-fences may define areas where a particular rail vehicle event is allowed. Geo-fences may define areas where a particular rail vehicle event is disallowed and/or particularly dangerous (e.g., approaching an intersection with a major street). Specific geo-fences may be associated with specific rail vehicle events.

Trigger component 36 may be configured to detect rail vehicle events. The rail vehicle events may be detected based on the output signals from sensors 12, the determined rail vehicle parameters, the determined rail vehicle operator parameters, the obtained pre-determined rail vehicle event criteria sets, and/or other information. The rail vehicle events may be detected by comparing the output signals, the determined parameters, and/or other information, to the criteria sets. For example, the first rail vehicle event may be detected responsive to the determined parameters satisfying the first criteria set. In some implementations, trigger component 36 may be configured to detect rail vehicle events in real-time or near real-time.

In some implementations, trigger component 36 may be configured to filter detected rail vehicle events based on the pre-determined geo-fences, and/or other information. In some implementations, trigger component 36 may be configured to adjust individual criteria in the rail vehicle event criteria sets based on a physical location of rail vehicle 8 relative to the pre-determined geo-fences, and/or other information.

As described above, trigger component 36 may be configured such that the rail vehicle events may be detected by comparing the output signals, the determined parameters, and/or other information, to the criteria sets. In some implementations, multiple individual parameters may need to satisfy multiple individual criteria in a criteria set before a rail vehicle event is detected. For example, determining the one or more rail vehicle parameters may include determining one or more rail vehicle parameters related to slingshotting (e.g., multiple side to side g-forces experienced by rail vehicle 8) and, responsive to the parameters related to slingshotting satisfying one or more individual slingshotting criteria (e.g., breaching side to side g-force threshold values), determining that slingshotting has occurred. As another example, determining the one or more rail vehicle parameters may include determining one or more rail vehicle parameters related to an improper stop at a station (e.g., distances between specific points on rail vehicle 8 and specific points on a passenger loading platform), and responsive to the parameters related to an improper stop at a station satisfying one or more individual improper stop criteria (e.g., the distances between rail vehicle 8 and the passenger loading platform exceeding distance threshold values), determining that an improper stop at a station has occurred.

In some implementations, a single parameter may satisfy rail vehicle event criteria for a specific rail vehicle event all by itself. For example, parameter component 32, criteria component 34, trigger component 36, and/or other processor components may be configured such that, in some implementations, determining one or more rail vehicle parameters may include determining whether an ATP overspeed system of rail vehicle 8 has been activated (e.g., a binary determination), and a determination that the ATP overspeed system has been activated may satisfy (continuing with the first rail vehicle event example described above) the first criteria set for the first rail vehicle event. As another example, determining one or more rail vehicle parameters may include determining whether an ATP bypass switch of rail vehicle 8 has been activated, and a determination that the ATP bypass switch has been activated may satisfy a second criteria set for a second rail vehicle event. As a third example, determining one or more rail vehicle parameters may include determining whether a track brake has been activated, and a determination that the track brake has been activated may satisfy a third criteria set for a third rail vehicle event. As a fourth example, determining one or more rail vehicle parameters may include determining whether an emergency brake of rail vehicle 8 has been activated, and a determination that the emergency brake has been activated may satisfy a fourth criteria set for a fourth rail vehicle event. As a fifth example, determining one or more rail vehicle parameters may include determining whether an intercom call has been made via an intercom system of rail vehicle 8, and a determination that an intercom call has been made may satisfy a fifth criteria set for a fifth rail vehicle event. As a sixth example, determining one or more rail vehicle parameters may include determining whether a high horn of rail vehicle 8 has been activated, and a determination that the high horn has been activated may satisfy a sixth criteria set for a sixth rail vehicle event. As a seventh example, determining one or more rail vehicle parameters may include determining whether a communications based train control (CBTC) system of rail vehicle 8 has been activated, and a determination that the CBTC system has been activated may satisfy a seventh criteria set for a seventh rail vehicle event. As an eighth example, determining one or more rail vehicle parameters may include determining whether a penalty stop has occurred, and a determination that a penalty stop has occurred may satisfy an eighth criteria set for an eighth rail vehicle event.

These examples are not intended to be limiting. System 10 is configured to detect any rail vehicle event as described herein (e.g., based on multiple parameters satisfying multiple individual criteria and/or a single parameter satisfying a criteria set).

Control component 38 may be configured to trigger rail vehicle event information recording (e.g., recording of video, audio, metadata, and/or other sensor information associated with a rail vehicle event) based on rail vehicle event detection. Event information may include video, audio, metadata, and/or other sensor data for a period of time that lasts from before a given rail vehicle event starts until after it ends. The period of time for which information is recorded may be determined based on a timing of the rail vehicle event, a point in time at which the rail vehicle event is detected, and/or other information. Control component 38 may be configured to trigger recording of substantially all rail vehicle event information (e.g., video, audio, sensor output signals, etc.), and not just the signals and/or parameters used for rail vehicle event detection. Control component 38 may be configured such that the event information is saved to a non-volatile memory (e.g., included in electronic storage 22) and later offloaded wirelessly and/or via wires, and/or control component 38 may be configured such that rail vehicle event information is wirelessly communicated (e.g., via transceiver 16) to one or more remote computing devices in real-time or near real-time.

In some implementations, control component 38 may be configured to selectively determine one or more types of information that are recorded based on individual rail vehicle events. In some implementations, control component 38 may selectively determine whether to record one or more types of video information, audio information, and/or other sensor information. For example, if the detected rail vehicle event involved a rail vehicle moving in reverse, control component 38 may cause a video stream from a rear-facing camera 14 to be included in the vehicle event information, whereas the view from the rear-facing camera 14 may not be needed when recording vehicle event information for other (non-reversing) rail vehicle events.

In some implementations, control component 38 may cause user interface 20 to display an indication of a detected rail vehicle event to an operator of a rail vehicle and/or other users of system 10. In some implementations, control component 38 may cause a remote computing system to display an indication of the detected vehicle event to an operator of the rail vehicle, and/or other users of system 10. The electronic indication may include, for example, an identification of the detected rail vehicle event, information related to the one or more parameters that satisfied the criteria in a predetermined criteria set, and/or other information.

Transceiver 16 may comprise wireless communication components configured to transmit and receive electronic information. In some implementations, processor 30 may be configured to facilitate wireless communication of rail vehicle event information to a remote computing device via transceiver 16 and/or other wireless communication components. Transceiver 16 may be configured to transmit and/or receive encoded communication signals. Transceiver 16 may include a base station and/or other components. In some implementations, transceiver 16 may be configured to transmit and receive signals via one or more radio channels of a radio link; via one or more wireless networks such as a Wi-Fi network, the internet, a cellular network, and/or other wireless networks; and/or other communication networks. In some implementations, transceiver 16 may be configured to transmit and receive communication signals substantially simultaneously.

User interface 20 may be configured to provide an interface between system 10 and users through which the users may provide information to and receive information from system 10. This enables pre-determined profiles, criteria, data, cues, results, instructions, and/or any other communicable items, collectively referred to as "information," to be communicated between a user and one or more of processor 30, sensors 12, remote computing devices, cameras 14, electronic storage 22, rail vehicle subsystems, and/or other components of system 10. In some implementations, all and/or part of user interface 20 may be included in a remote computing device, an operator identity system, and/or other components of system 10. In some implementations, user interface 20 may be included in a housing with one or more other components (e.g., processor 30) of system 10.

Examples of interface devices suitable for inclusion in user interface 20 comprise a keypad, buttons, switches, a keyboard, knobs, levers, a display screen, a touch screen, speakers, a microphone, an indicator light, an audible alarm, a printer, a tactile feedback device, and/or other interface devices. In one implementation, user interface 20 comprises a plurality of separate interfaces (e.g., one interface in the driver compartment of rail vehicle 8 and one interface included in a remote computing device). In some implementations, user interface 20 comprises at least one interface that is provided integrally with processor 30 and/or electronic storage 22.

It is to be understood that other communication techniques, either hard-wired or wireless, are also contemplated by the present disclosure as user interface 20. In some implementations, user interface 20 may be included in a removable storage interface provided by electronic storage 22. In this example, information may be loaded into system 10 wirelessly from a remote location (e.g., via a network), from removable storage (e.g., a smart card, a flash drive, a removable disk, etc.), and/or other sources that enable the user(s) to customize the implementation of system 10. Other exemplary input devices and techniques adapted for use with system 10 as user interface 20 comprise, but are not limited to, an RS-232 port, RF link, an IR link, modem (telephone, cable, and/or other modems), a cellular network, a Wi-Fi network, a local area network, and/or other devices and/or systems. In short, any technique for communicating information with system 10 is contemplated by the present disclosure as user interface 20.

Electronic storage 22 may be configured to store electronic information. Electronic storage 22 may comprise electronic storage media that electronically stores information. The electronic storage media of electronic storage 22 may comprise one or both of system storage that is provided integrally (i.e., substantially non-removable) with system 10 and/or removable storage that is removably connectable to system 10 via, for example, a port (e.g., a USB port, a firewire port, etc.) or a drive (e.g., a disk drive, etc.). Electronic storage 22 may comprise one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 22 may store software algorithms, recorded video event data, information determined by processor 30, information received via user interface 20, and/or other information that enables system 10 to function properly. Electronic storage 22 may be (in whole or in part) a separate component within system 10, or electronic storage 22 may be provided (in whole or in part) integrally with one or more other components of system 10 (e.g., user interface 20, processor 30, etc.).

In some implementations, system 10 and/or individual components of system 10 may be coupled with rail vehicle 8 at one or more locations on and/or within rail vehicle 8. In some implementations, system 10 may be coupled with rail vehicle 8 in locations that facilitate communication with one or more subsystems of rail vehicle 8, one or more rail third party products, and/or other components of rail vehicle 8.

Figure 2:
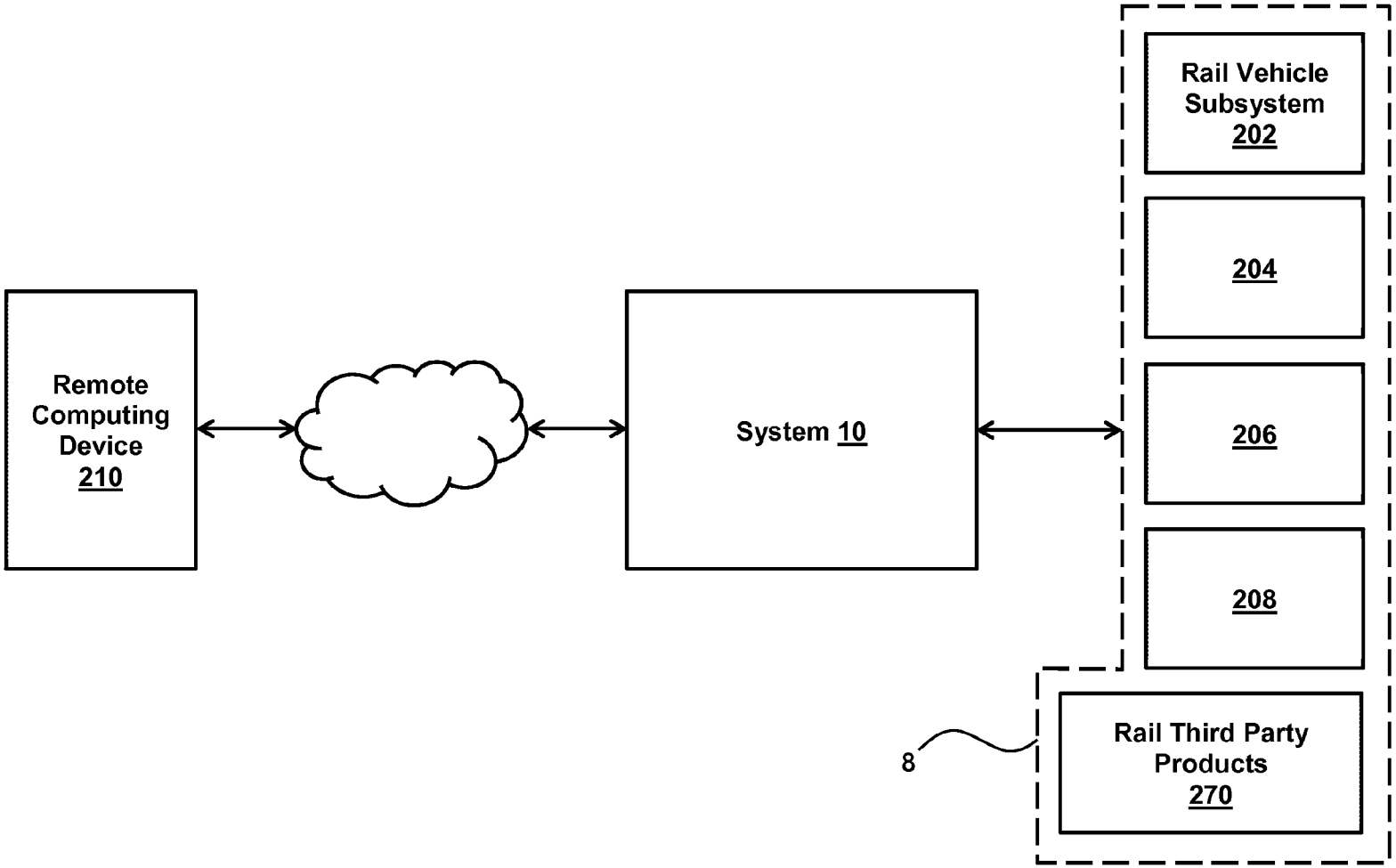
FIG. 2 illustrates the system in communication with rail vehicle subsystems of a rail vehicle, rail third party products, and a remote computing device.

For example, FIG. 2 illustrates system 10 in communication with rail vehicle subsystems 202, 204, 206, and 208, rail third party products 270, and a remote computing device 210. Rail vehicle subsystems may include mechanical subsystems, vehicle safety subsystems, track safety subsystems, inter-railcars safety subsystems, camera subsystems, DVR subsystems, and/or other rail vehicle subsystems (e.g., described above related to sensors 12). System 10 may be configured to be coupled with rail vehicle 8 subsystems so that information may be transmitted wirelessly and/or system 10 may be physically coupled with rail vehicle 8 subsystems via wires and/or other physical couplings. As shown in FIG. 2, system 10 may be configured to communicate (e.g., wirelessly and/or via wires) with one or more remote computing devices 210. System 10 may communicate information (e.g., rail vehicle event information and/or other information) to remote computing device 210 and/or receive information from remote computing device 210 (e.g., information related to settings and/or other control of system 10, and/or other information.)

In some implementations, system 10 may be configured to communicate with other rail third party products 270 (DVR systems, safety systems, etc.). For example, system 10 may be configured to be physically coupled with a rail third party DVR system. As another example, system 10 may be configured to communicate with a CBTC safety system via a physical coupling. In some implementations, system 10 may be configured to communicate information to and/or receive information from third party products 270 wirelessly and/or via wires.

Remote computing device 210 may include one or more processors, a user interface, electronic storage, and/or other components. Remote computing device 210 may be configured to enable a user to interface with system 10, and/or provide other functionality attributed herein to remote computing device 210. Remote computing device 210 may be configured to communicate with system 10 via a network such as the internet, cellular network, Wi-Fi network, Ethernet, and other interconnected computer networks. Remote computing device 210 may facilitate viewing and/or analysis of the information conveyed by output signals of sensors 12 (FIG. 1), information determined by processor 30 (FIG. 1), information stored by electronic storage 22 (FIG. 1), and/or other information. By way of non-limiting example, remote computing device 210 may include one or more of a server, a server cluster, desktop computer, a laptop computer, a handheld computer, a tablet computing platform, a NetBook, a Smartphone, a gaming console, and/or other computing platforms.

As described above, in some implementations, remote computing device 210 may be and/or include a server. The server may include communication lines and/or ports to enable the exchange of information with a network, processor 30 of system 10, and/or other computing platforms. The server may include a plurality of processors, electronic storage, hardware, software, and/or firmware components operating together to provide the functionality attributed herein to remote computing device 210. For example, the server may be implemented by a cloud of computing platforms operating together as a system server.

Figure 3:
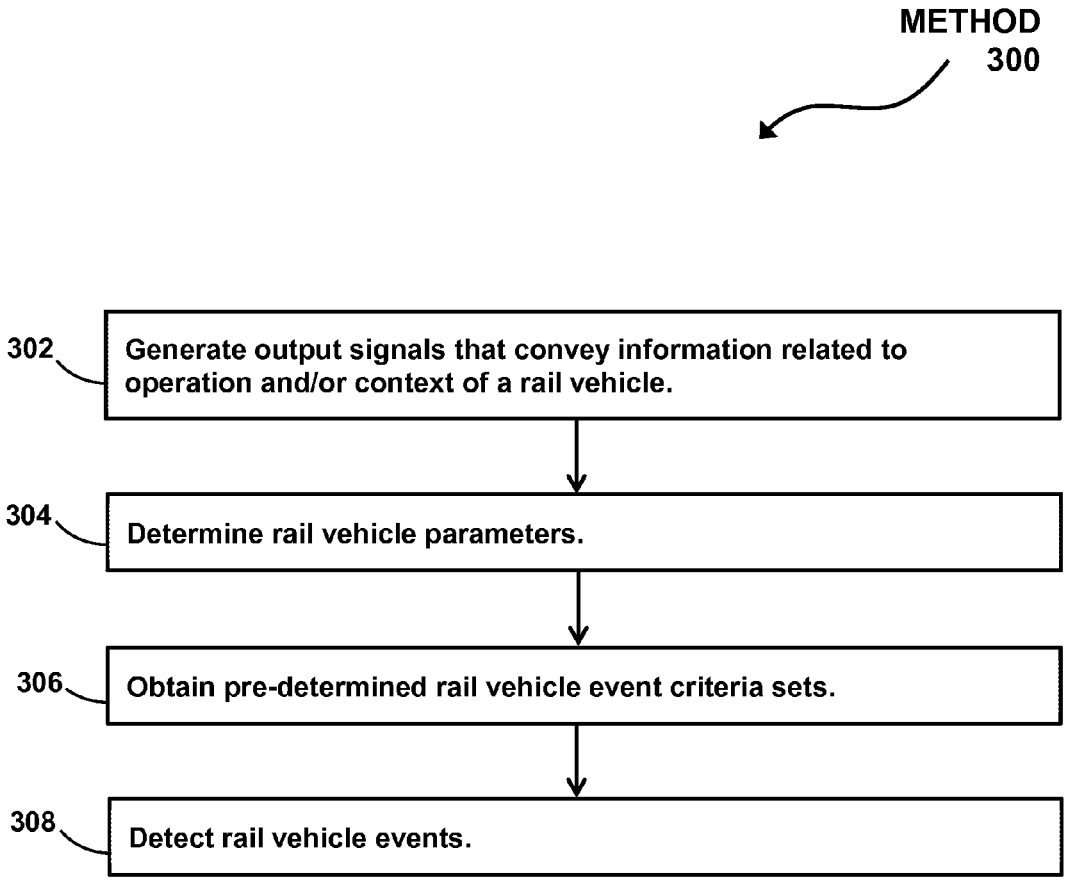
FIG. 3 illustrates a method for detecting rail vehicle events based on pre-determined rail vehicle event criteria sets and/or other information.

FIG. 3 illustrates a method 300 for detecting rail vehicle events based on pre-determined rail vehicle event criteria sets and/or other information. The operations of method 300 presented below are intended to be illustrative. In some implementations, method 300 may be accomplished with one or more additional operations not described, and/or without one or more of the operations discussed. Additionally, the order in which the operations of method 300 are illustrated in FIG. 3 and described below is not intended to be limiting. In some implementations, for example, two or more of the operations may occur substantially simultaneously.

In some implementations, method 300 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 300 in response to instructions stored electronically on one or more electronic storage mediums. The one or more processing devices may include one or more devices configured through hardware, firmware, and/or software to be specifically designed for execution of one or more of the operations of method 300.

At an operation 302, output signals conveying information related to the operation and/or context of the rail vehicle and/or other information may be generated. In some implementations, generating output signals conveying information related to the operation and/or the context of the rail vehicle may include acquiring visual information representing the rail vehicle environment. The rail vehicle environment may include spaces in and around an interior and an exterior of the rail vehicle. In some implementations, the output signals may convey information related to safety systems of the rail vehicle, mechanical systems of the rail vehicle, communication systems of the rail vehicle, passengers riding in the rail vehicle, an operator of the rail vehicle, movement of the rail vehicle, an orientation of the rail vehicle, a geographic position of the rail vehicle, a track the rail vehicle rides on, a spatial position of the rail vehicle relative to other objects, and/or other information. Such output signals may be generated by one or more vehicle subsystem sensors, one or more third party aftermarket sensors, and/or other sensors. In some implementations, operation 302 may include generating output signals that convey information related to biological activity (e.g., heart rate, respiration rate, verbal expressions, responses to conditions in the physical environment in and/or around the rail vehicle, etc.) of a vehicle operator. In some implementations, operation 302 may be performed by one or more sensors the same as or similar to sensors 12 (shown in FIG. 1 and described herein).

At an operation 304, rail vehicle parameters may be determined. The rail vehicle parameters may be determined based on the output signals, and/or other information. The one or more rail vehicle parameters may be related to the operation and/or context of the rail vehicle and/or other information. In some implementations, operation 304 may include determining one or more rail vehicle operator parameters based on the output signals that convey the information related to the biological activity of the vehicle operator and/or other information. The one or more rail vehicle operator parameters may be related to an excitement level of the rail vehicle operator, and/or other characteristics of the rail vehicle operator. In some implementations, operation 304 may be performed by a processor component the same as or similar to parameter component 32 (shown in FIG. 1 and described herein).

At an operation 306, pre-determined rail vehicle event criteria sets may be obtained. The one or more pre-determined rail vehicle event criteria sets may include criteria sets associated with individual rail vehicle events and/or other criteria sets. For example, the one or more pre-determined rail vehicle event criteria sets may include a first criteria set that corresponds to a first rail vehicle event. The first criteria set may include one or more individual criterion, for example. In some implementations, operation 306 may be performed by a processor component the same as or similar to criteria component 34 (shown in FIG. 1 and described herein).

At an operation 308, rail vehicle events may be detected. The rail vehicle events may be detected based on the determined rail vehicle parameters, the obtained pre-determined rail vehicle event criteria sets, and/or other information. The rail vehicle events may be detected, for example, by comparing the determined rail vehicle parameters to the criteria sets such that the first rail vehicle event is detected responsive to the determined parameters satisfying the first criteria set.

In some implementations, operation 308 may include detecting rail vehicle events based on the determined rail vehicle operator parameters, the determined rail vehicle parameters, the obtained pre-determined rail vehicle event criteria sets, and/or other information. The rail vehicle events may be detected by comparing the determined rail vehicle operator parameters and the determined rail vehicle parameters to the criteria sets such that the first rail vehicle event is detected responsive to one or more of the rail vehicle operator parameters or the rail vehicle parameters satisfying the first criteria set, for example.

In some implementations, operation 308 may include filtering detected rail vehicle events based on pre-determined geo-fences, and/or other information. The geo-fences may be virtual boundaries that define physical areas where one or more rail vehicle events are permissible or are not permissible. In some implementations, operation 308 may include adjusting individual criteria in the rail vehicle event criteria sets based on a physical location of the rail vehicle relative to the pre-determined geo-fences. In some implementations, operation 308 may be performed by a processor component the same as or similar to trigger component 36 (shown in FIG. 1 and described herein).

The following paragraph describes several possible examples of one or more operations of method 300. These examples are not intended to be limiting. In some implementations, determining one or more rail vehicle parameters may include determining whether an ATP overspeed system of the rail vehicle has been activated and a determination that the ATP overspeed system has been activated may satisfy the first criteria set for the first rail vehicle event. Determining one or more rail vehicle parameters may include determining whether an ATP bypass switch of the rail vehicle has been activated and a determination that the ATP bypass switch has been activated may satisfy the first criteria set for the first rail vehicle event. Determining one or more rail vehicle parameters may include determining whether a track brake has been activated and a determination that the track brake has been activated may satisfy the first criteria set for the first rail vehicle event. Determining one or more rail vehicle parameters may include determining whether an emergency brake of the rail vehicle has been activated and a determination that the emergency brake has been activated may satisfy the first criteria set for the first rail vehicle event. Determining one or more rail vehicle parameters may include determining whether an intercom call has been made via an intercom system of the rail vehicle and a determination that an intercom call has been made may satisfy the first criteria set for the first rail vehicle event. Determining one or more rail vehicle parameters may include determining whether a high horn of the rail vehicle has been activated and a determination that the high horn has been activated may satisfy the first criteria set for the first rail vehicle event. Determining one or more rail vehicle parameters may include determining whether a communications based train control (CBTC) system of the rail vehicle has been activated and a determination that the CBTC system has been activated may satisfy the first criteria set for the first rail vehicle event. Determining one or more rail vehicle parameters may include determining whether a penalty stop has occurred and a determination that a penalty stop has occurred may satisfy the first criteria set for the first rail vehicle event. Determining the one or more rail vehicle parameters may include determining one or more rail vehicle parameters related to slingshotting and, responsive to the parameters related to slingshotting satisfying one or more individual slingshotting criteria, determining that slingshotting has occurred. Determining the one or more rail vehicle parameters may include determining one or more rail vehicle parameters related to an improper stop at a station and responsive to the parameters related to an improper stop at a station satisfying one or more individual improper stop criteria, determining that an improper stop at a station has occurred.

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system configured to detect rail vehicle events based on pre-determined rail vehicle event criteria sets, the system coupled to a rail vehicle, the system comprising:

one or more sensors configured to generate output signals conveying information related to operation and/or context of the rail vehicle; and one or more physical computer processors configured by computer readable instructions to:

determine one or more rail vehicle parameters based on the output signals, the one or more rail vehicle parameters being related to the operation and/or context of the rail vehicle;

obtain one or more pre-determined rail vehicle event criteria sets, the one or more pre-determined rail vehicle event criteria sets including criteria sets associated with individual rail vehicle events, the one or more predetermined rail vehicle event criteria sets including a first criteria set that corresponds to a first rail vehicle event, the first criteria set including a first individual criterion;

detect individual rail vehicle events based on the determined rail vehicle parameters and the obtained pre-determined rail vehicle event criteria sets by comparing the determined rail vehicle parameters to the criteria sets such that the first rail vehicle event is detected responsive to the determined parameters satisfying the first criteria set;

determine one or more rail vehicle operator parameters based on the output signals from the biological information sensors, the one or more rail vehicle operator parameters being related to an excitement level of the rail vehicle operator; and detect rail vehicle events based on the determined rail vehicle operator parameters, the determined rail vehicle parameters, and the obtained pre-determined rail vehicle event criteria sets by comparing the determined rail vehicle operator parameters and the determined rail vehicle parameters to the criteria sets such that the first rail vehicle event is detected responsive to one or more of the rail vehicle operator parameters or the rail vehicle parameters satisfying the first criteria set.

2. The system of claim 1, wherein the one or more sensors generate output signals conveying information related to one or more of safety systems of the rail vehicle, mechanical systems of the rail vehicle, communication systems of the rail vehicle, passengers riding in the rail vehicle, an operator of the rail vehicle, movement of the rail vehicle, an orientation of the rail vehicle, a geographic position of the rail vehicle, a track the rail vehicle rides on, or a spatial position of the rail vehicle relative to other objects.

3. The system of claim 1, wherein the one or more physical computer processors are configured such that:

determining one or more rail vehicle parameters includes determining whether an ATP overspeed system of the rail vehicle has been activated; and a determination that the ATP overspeed system has been activated satisfies the first criteria set for the first rail vehicle event.

4. The system of claim 1, wherein the one or more physical computer processors are configured such that:

determining one or more rail vehicle parameters includes determining whether an ATP bypass switch of the rail vehicle has been activated; and a determination that the ATP bypass switch has been activated satisfies the first criteria set for the first rail vehicle event.

5. The system of claim 1, wherein the one or more physical computer processors are configured such that:

determining one or more rail vehicle parameters includes determining whether a track brake has been activated; and a determination that the track brake has been activated satisfies the first criteria set for the first rail vehicle event.

6. The system of claim 1, wherein the one or more physical computer processors are configured such that:

determining one or more rail vehicle parameters includes determining whether an emergency brake of the rail vehicle has been activated; and a determination that the emergency brake has been activated satisfies the first criteria set for the first rail vehicle event.

7. The system of claim 1, wherein the one or more physical computer processors are configured such that:

determining one or more rail vehicle parameters includes determining whether an intercom call has been made via an intercom system of the rail vehicle; and a determination that an intercom call has been made satisfies the first criteria set for the first rail vehicle event.

8. The system of claim 1, wherein the one or more physical computer processors are configured such that:

determining one or more rail vehicle parameters includes determining whether a high horn of the rail vehicle has been activated; and a determination that the high horn has been activated satisfies the first criteria set for the first rail vehicle event.

9. The system of claim 1, wherein the one or more physical computer processors are configured such that:

determining one or more rail vehicle parameters includes determining whether a communications based train control (CBTC) system of the rail vehicle has been activated; and a determination that the CBTC system has been activated satisfies the first criteria set for the first rail vehicle event.

10. The system of claim 1, wherein the one or more physical computer processors are configured such that:

determining one or more rail vehicle parameters includes determining whether a penalty stop has occurred; and a determination that a penalty stop has occurred satisfies the first criteria set for the first rail vehicle event.

11. The system of claim 1, wherein the one or more physical computer processors are configured to determine one or more rail vehicle parameters related to slingshotting; and responsive to the parameters related to slingshotting satisfying one or more individual slingshotting criteria, determining that slingshotting has occurred.

12. The system of claim 1, wherein the one or more physical computer processors are configured to determine one or more rail vehicle parameters related to an improper stop at a station; and responsive to the parameters related to an improper stop at a station satisfying one or more individual improper stop criteria, determining that an improper stop at a station has occurred.

13. The system of claim 1, wherein the one or more physical computer processors are configured to filter detected rail vehicle events based on pre-determined geo-fences, wherein geo-fences are virtual boundaries that define physical areas where one or more rail vehicle events are permissible or are not permissible.

14. The system of claim 13, wherein the one or more physical computer processors are configured to adjust individual criteria in the rail vehicle event criteria sets based on a physical location of the rail vehicle relative to the pre-determined geo-fences.

15. A method for detecting rail vehicle events based on pre-determined rail vehicle event criteria sets, the method comprising:

generating output signals conveying information related to operation and/or context of a rail vehicle;

determining one or more rail vehicle parameters based on the output signals, the one or more rail vehicle parameters being related to the operation and/or context of the rail vehicle;

obtaining one or more pre-determined rail vehicle event criteria sets, the one or more pre-determined rail vehicle event criteria sets including criteria sets associated with individual rail vehicle events, the one or more pre-determined rail vehicle event criteria sets including a first criteria set that corresponds to a first rail vehicle event, the first criteria set including a first individual criterion;

detecting individual rail vehicle events based on the determined rail vehicle parameters and the obtained pre-determined rail vehicle event criteria sets by comparing the determined rail vehicle parameters to the criteria sets such that the first rail vehicle event is detected responsive to the determined parameters satisfying the first criteria set;

determining one or more rail vehicle operator parameters based on the output signals that convey the information related to the biological activity of the vehicle operator, the one or more rail vehicle operator parameters being related to an excitement level of the rail vehicle operator; and detecting rail vehicle events based on the determined rail vehicle operator parameters, the determined rail vehicle parameters, and the obtained predetermined rail vehicle event criteria sets by comparing the determined rail vehicle operator parameters and the determined rail vehicle parameters to the criteria sets such that the first rail vehicle event is detected responsive to one or more of the rail vehicle operator parameters or the rail vehicle parameters satisfying the first criteria set.

16. The method of claim 15, wherein the output signals convey information related to one or more of safety systems of the rail vehicle, mechanical systems of the rail vehicle, communication systems of the rail vehicle, passengers riding in the rail vehicle, an operator of the rail vehicle, movement of the rail vehicle, an orientation of the rail vehicle, a geographic position of the rail vehicle, a track the rail vehicle rides on, or a spatial position of the rail vehicle relative to other objects.

17. The method of claim 15, wherein:

determining one or more rail vehicle parameters includes determining whether an ATP overspeed system of the rail vehicle has been activated; and a determination that the ATP overspeed system has been activated satisfies the first criteria set for the first rail vehicle event.

18. The method of claim 15, wherein:

determining one or more rail vehicle parameters includes determining whether an ATP bypass switch of the rail vehicle has been activated; and a determination that the ATP bypass switch has been activated satisfies the first criteria set for the first rail vehicle event.

19. The method of claim 15, wherein:

determining one or more rail vehicle parameters includes determining whether a track brake has been activated; and a determination that the track brake has been activated satisfies the first criteria set for the first rail vehicle event.

20. The method of claim 15, wherein:

determining one or more rail vehicle parameters includes determining whether an emergency brake of the rail vehicle has been activated; and a determination that the emergency brake has been activated satisfies the first criteria set for the first rail vehicle event.

21. The method of claim 15, wherein:

determining one or more rail vehicle parameters includes determining whether an intercom call has been made via an intercom system of the rail vehicle; and a determination that an intercom call has been made satisfies the first criteria set for the first rail vehicle event.

22. The method of claim 15, wherein:

determining one or more rail vehicle parameters includes determining whether a high horn of the rail vehicle has been activated; and a determination that the high horn has been activated satisfies the first criteria set for the first rail vehicle event.

23. The method of claim 15, wherein:

determining one or more rail vehicle parameters includes determining whether a communications based train control (CBTC) system of the rail vehicle has been activated; and a determination that the CBTC system has been activated satisfies the first criteria set for the first rail vehicle event.

24. The method of claim 15, wherein:

determining one or more rail vehicle parameters includes determining whether a penalty stop has occurred; and a determination that a penalty stop has occurred satisfies the first criteria set for the first rail vehicle event.

25. The method of claim 15, wherein determining the one or more rail vehicle parameters includes determining one or more rail vehicle parameters related to slingshotting; and responsive to the parameters related to slingshotting satisfying one or more individual slingshotting criteria, determining that slingshotting has occurred.

26. The method of claim 15, wherein determining the one or more rail vehicle parameters includes determining one or more rail vehicle parameters related to an improper stop at a station; and responsive to the parameters related to an improper stop at a station satisfying one or more individual improper stop criteria, determining that an improper stop at a station has occurred.

27. The method of claim 15, further comprising filtering detected rail vehicle events based on pre-determined geo-fences, wherein geo-fences are virtual boundaries that define physical areas where one or more rail vehicle events are permissible or are not permissible.

28. The method of claim 27, further comprising adjusting individual criteria in the rail vehicle event criteria sets based on a physical location of the rail vehicle relative to the pre-determined geo-fences.

* * * * *